United States Patent [19]

Hyman

[11] 4,100,712

[45] Jul. 18, 1978

[54] HOLE REPAIR KIT

[76] Inventor: Henry F. Hyman, 3718 Old San Jose Rd., Santa Cruz, Calif. 95065

[21] Appl. No.: 691,506

[22] Filed: Jun. 1, 1976

Related U.S. Application Data

[63] Continuation-in-part of Ser. No. 664,374, Mar. 5, 1976, abandoned.

[51] Int. Cl.[2] ..... E04G 23/02

[52] U.S. Cl. ..... 52/514

[58] Field of Search ..... 52/514, 127, 365, 345; 29/401, 404

[56] References Cited

U.S. PATENT DOCUMENTS

| | | | |
|---|---|---|---|
| 2,598,194 | 5/1952 | Shippey | 52/514 |
| 2,997,416 | 8/1961 | Helton | 52/514 |
| 3,289,374 | 12/1966 | Metz | 52/514 |
| 3,373,467 | 3/1968 | Loughrey | 52/514 |
| 3,690,084 | 9/1972 | Leblanc | 52/514 |
| 3,834,107 | 9/1974 | Standing | 52/514 |

*Primary Examiner*—Alfred C. Perham
*Assistant Examiner*—Robert C. Farber
*Attorney, Agent, or Firm*—Paul B. Fihe

[57] ABSTRACT

A repair kit for holes in walls including a thin flexible support plate dimensioned to bridge a hole to be repaired, a cooperating reaction member also arranged to bridge the hole, and means for holding the plate and reaction member against opposed wall surface adjacent the hole.

6 Claims, 5 Drawing Figures

HOLE REPAIR KIT

This case is a continuation-in-part of application Ser. No. 664,374, filed Mar. 5, 1976, now abandoned.

THE FIELD OF THE INVENTION

The present invention relates to wall repairing apparatus and more particularly to a repair kit that can be utilized to assist in the repair of rather large holes inadvertently formed in SHEETROCK, plaster, or other walls.

BACKGROUND OF THE INVENTION

Small holes formed by nails or the like in a SHEETROCK or plaster wall are readily repaired by the placement therein of a patching mixture which is in paste-like form that dries upon hardening. When the hole is small, the cohesiveness of the material and its adhesion to the surrounding wall surface are sufficient to hold the same during the drying process, but on the other hand, if the hole is relatively large, say for example, a 2-inch hole formed by the banging of a door knob against a wall, the paste is not capable of self-support and the repair becomes a difficult, if not impossible task. In many instances, an entire 4 by 8 panel of SHEETROCK has been torn out and replaced, an obviously expensive and time consuming chore.

SUMMARY OF THE INVENTION

Accordingly, it is the general objective of the present invention to provide a rather simple hole repair kit for walls or the like which can be utilized by the most inexperienced layman to repair holes of substantial size quickly and easily.

Briefly, the repair kit includes a support plate preferably formed of rather thin metallic material whose lateral dimensions are such that it is capable of bridging the particular hole which is to be repaired. At least the peripheral portion of the support plate is flexible and slightly resilient so that it can be pushed through the hole and thereafter allowed to expand into bridging relationship across the inner unexposed surface of the wall, much in the fashion of the well-known toggle fasteners. Preferably, the plate is radially slit partially inward towards its center to enhance the mentioned flexibility and also is perforated so that the paste, which is subsequently applied, can penetrate such perforations and maintain good adhering relationship with the support plate over the entire area of the hole. A slight modification provides for sharp scallops on the periphery of the plate to further enhance its gripping power.

A reaction member is arranged to be of sufficient length to bridge the opening across the other outer exposed surface of the wall and the two members are interconnected by means which will hold them simultaneously against such opposite wall surfaces. Preferably, the support plate and the reaction member are both centrally apertured to allow loose passage therethrough of a small bolt or machine screw whose head engages the reaction member on the exposed surface of the wall and which has applied thereto at its inner end on the remote side of the support plate a toggle nut so that when the two elements are moved into the positions on opposite sides of the wall, a tightening of the bolt or machine screw with a conventional screwdriver will bring the two members into opposed contacting holding engagement with the wall surfaces.

At this time, the paste can be applied in the hole and be pushed sufficiently inward to pass through at least some of the perforations in the support plate so that good adherence and support of the paste while it dries is assured. The reaction member can then be rotated manually on its supporting bolt so as to generate a smooth flat surface which is coplanar with the surrounding wall surface. After the paste has completely dried, the bolt can be loosened to allow removal of the reaction member and the small hole resultant from the bolt removal can then be repaired with a slight additional amound of paste to provide the finished surface.

BRIEF DESCRIPTION OF THE DRAWINGS

The stated objective of the invention and the manner in which it is achieved as summarized hereinabove will be more readily understood by reference to the following detailed description of the exemplary structure shown in the accompanying drawings wherein.

DETAILED DESCRIPTION OF THE EXEMPLARY EMBODIMENTS OF THE INVENTION

Figure 1:
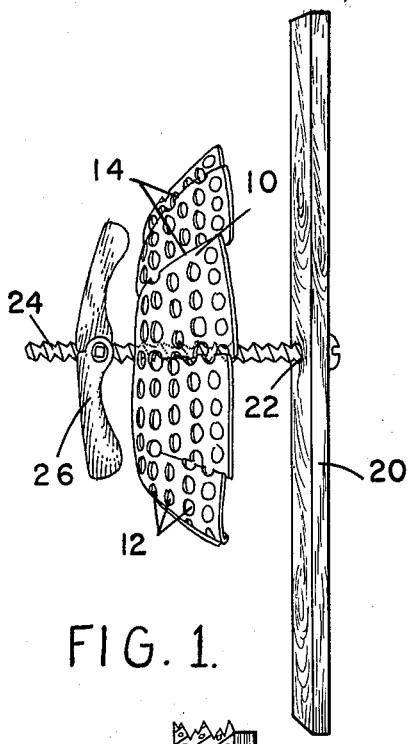
FIG. 1 is a side view of a hole repair kit constituting one embodiment of the present invention.
Figure 2:
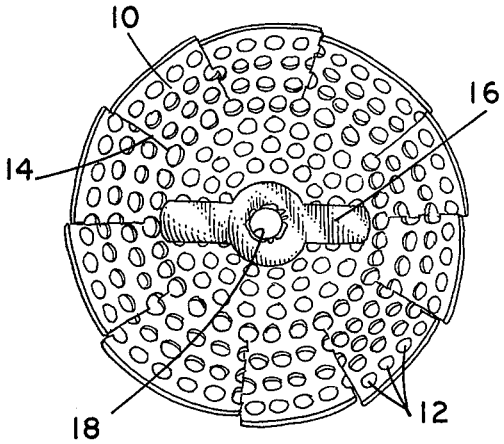
FIG. 2 is a plan view of the front surface of a support plate forming one element of the FIG. 1 assembly.
Figure 4:
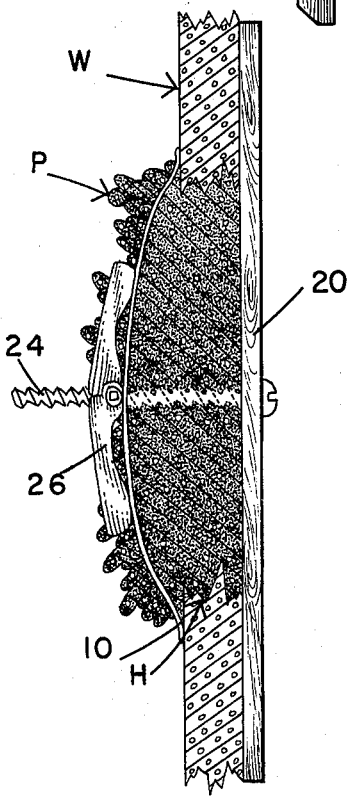
FIG. 4 is a central sectional view through a wall and hole which is being repaired through utilization of the repair kit.
Figure 3:
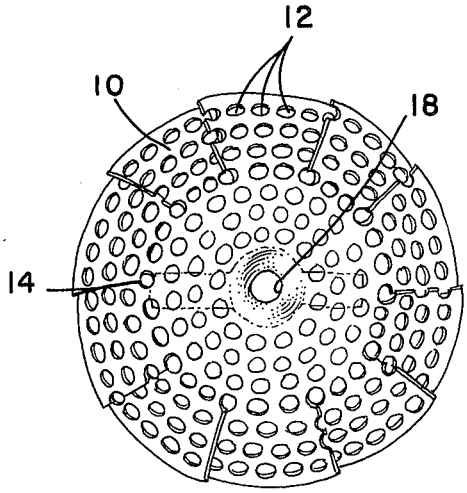
FIG. 3 is a rear plan view of the same support plate.

As shown in FIGS. 1–4 the repair kit includes a support plate 10 which, as illustrated, is a thin plate or disc composed of aluminum or other material that is slightly flexible. The plate 10 has a circular periphery and a plurality of apertures or perforations 12 closely spaced over substantially its entire surface. In addition, the plate 10 has partial radial slits 14 extending inwardly in a number of positions from its periphery which in turn enhance the flexibility of the plate so that it can be shoved through a hole H whose dimensions are slightly less than the lateral dimensions of the plate itself. Preferably, the plate material is also slightly resilient so that after the support plate has been pushed through the hole, it will naturally expand into bridging relationship over the hole into contact with the adjacent wall surface W as shown in FIG. 4. Preferably, a central brace 16 is riveted or otherwise secured to the center of the plate so that its central section has some added rigidity and, as best shown in FIGS. 2 and 3, the central portion of the plate has a small hole 18 therethrough for a purpose to be described hereinafter.

A reaction member 20 which is preferably in the form of a narrow, elongated strip of wood or other substantially rigid material is arranged to flatly lie adjacent the opposite surface of the wall W as can be best visualized by reference to FIG. 4 and is also provided with a central hole 22 which allows together with the described hole 18 in the support plate 10, the passage of an elongated machine screw or bolt 24 through such openings to provide in conjunction with a conventional toggle nut 26, means for clamping the support plate 10 and the reaction member 20 against the opposite surfaces of the wall W when the machine screw or bolt is tightened as is clearly illustrated in FIG. 4.

When the assembly is thus completed, the patching paste material P can be applied in the wall hole H and pushed therein so that at least portions of the material will pass through some of the perforations 12 in the plate 10 and, as illustrated in FIG. 4. The flat reaction member 20 can then be rotated about the axis defined by the connecting bolt 24 to provide for a smoothing of the paste in coplanar relationship with the surround wall surface. After a predetermined period, the paste P will dry and harden in a conventional fashion and the bolt 24 can be simply loosened by a screwdriver and the reaction member 20 removed. To complete the hole repair, the small remaining hole can be patched conventionally. It will be noted that support plate 10 remains permanently in position and thus maintains support of the repaired area of the wall.

Figure 5:
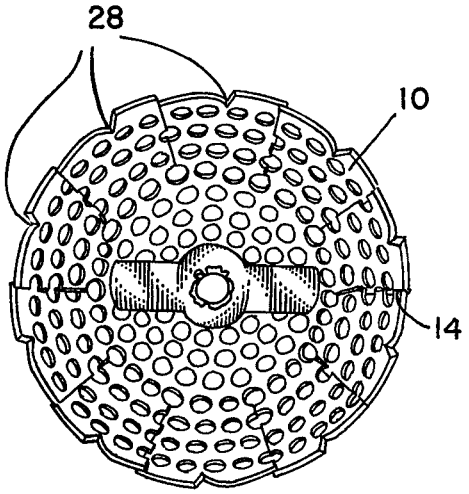
FIG. 5 is a view similar to FIG. 2 showing a modified embodiment of the invention.

A slightly modified embodiment of the invention is shown in FIG. 5 having corresponding reference numerals with an added prime notation. The plate 10' at peripheral positions between the radial slits 14' has scallops or indentations 28 which form sharp projecting corners enhancing the gripping of the wall.

It will be obvious that various sizes of support plate and reaction members can be utilized to accommodate holes of varied dimensions and the operation will remain substantially as described hereinabove. Furthermore, other securing mechanisms can be utilized rather than the bolt and toggle nut specifically described and accordingly the foregoing description of one embodiment is to be considered purely as exemplary and not in a limiting sense and the actual scope of the invention is to be indicated only by reference to the appended claims.

What is claimed is:

1. A repair kit for holes in walls or the like which comprises only a single support plate dimensioned to bridge a hole to be repaired in a wall and having a flexible peripheral portion incuding partial radial slits extending inwardly from its peripheral edge which allows the plate to be pushed through the hole of smaller dimensions and subsequent expansion into hole-bridging relationship, a reaction member of sufficient length to bridge the hole, and means interconnecting said support plate and said reaction member to hold them against opposed surfaces of the wall.

2. A repair kit according to claim 1 wherein said support plate is perforated.

3. A repair kit according to claim 1 wherein said plate is composed of slightly resilient material.

4. A repair kit according to claim 1 wherein said support plate and said reaction member have substantially central openings and said interconnecting means includes a bolt passing through said openings and a toggle nut threadedly mounted on said bolt.

5. A repair kit according to claim 4 wherein said reaction member lies flatly against the wall surface and is free to rotate on said bolt.

6. A repair kit according to claim 1 wherein said support plate has scallops formed in its peripheral edge.

* * * * *